United States Patent [19]

Colson

[11] Patent Number: 5,057,671

[45] Date of Patent: Oct. 15, 1991

[54] SOLUTION WARMING UNIT

[76] Inventor: Charles R. Colson, 4702 N. Laurent, Victoria, Tex. 77904

[21] Appl. No.: 395,069

[22] Filed: Aug. 7, 1989

[51] Int. Cl.[5] ..... H05B 3/00

[52] U.S. Cl. ..... 219/521; 219/386

[58] Field of Search ..... 219/385, 386, 521

[56] References Cited

U.S. PATENT DOCUMENTS

| | | | |
|---|---|---|---|
| 1,805,291 | 5/1931 | Monnot | 219/521 |
| 1,993,330 | 3/1935 | Latiolais | 219/521 |
| 2,177,101 | 10/1939 | Franzwa | 219/521 |
| 2,413,176 | 12/1946 | Deaton | 219/521 |
| 2,604,573 | 7/1952 | Raines | 219/521 |
| 2,713,112 | 7/1955 | Mills | 219/521 |
| 2,748,495 | 6/1956 | Murray | 219/521 |

*Primary Examiner*—Teresa J. Walberg

[57] ABSTRACT

A device for warming bottles of solution includes a rectangular plastic housing with holes in an upper wall to receive large bottles and a front door which can be opened to receive small bottles. The bottles are heated by a bulb which is supported by a lower wall of the housing.

1 Claim, 2 Drawing Sheets

SOLUTION WARMING UNIT

BACKGROUND OF THE INVENTION

This invention relates to sufficiently warming various consistencies of solutions at concentrated and diluted forms. It will distinctively warm 4 oz. and 16 oz. bottles of solution. For example, these solutions are as follows: alcohol, shampoos, hair conditioners, therapeutic lotions and neutralizers used in applications in perming hair and in warming water needed for specific reasons.

There are several different purposeful applications for this invention. It is generally known by many patrons who patronize barber and beauty salons frequently that there is a definite need for solutions to be warmed before application to hair and scalp not only for penetration purposes but allows the patron to remain comfortable during services rendered. Products warmed in this invention have been found to be equally beneficial to operators servicing patrons.

Likewise, patients needing therapeutic messages, chiropractic services, hospital and nursing home care have found it extremely comforting to have applicable solutions warmed.

There are other types of warmers that are expensively manufactured, cumbersome to use and costly to operate, whereas this invention is manufactured economically and at an extremely low cost of maintenance.

This invention is an attractive unit that may be placed in the workplace such as on countertops, shelving or on a stand. The illuminating light passing through the unit has a glowing effect, which attractively becomes noticed as a nightlight for the area in which it is placed. The source of light being an electrical candelabra bulb is strategically positioned at a specific location to warm 4 (16 oz.) and 3 (4 oz.) bottles and will maintain an ideal warm temperature for 24 hour use. The 4 oz. bottles are accessible through a door at the front, which is opened with a small tab extending to the right side of the door, used as a door handle. The 16 oz. bottles are accessible through 4 holes at the top of the unit. The invention will continually warm all bottles, whether partially or completely filled with solution. The 4 holes in which the 16 oz. bottles are placed are purposefully cut at a specific size larger than the diameter of the bottles so that air may circulate around the bottles, warming the complete 16 oz. contents. These holes also keep the contents from becoming too warm because this extra air will rise out of the unit, making this warming unit self-regulating.

A noticeable feature is that with operation of the unit, the exterior is comfortable to the touch; therefore, it may be moved easily. This is chiefly because of the acrylic material with which it is constructed.

DESCRIPTION OF THE PREFERRED EMBODIMENT

Figure 1:
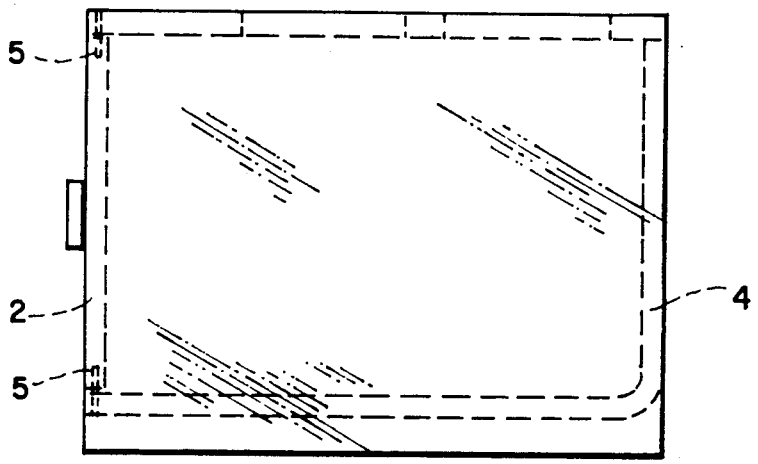
FIG. 1 is a side view showing simplicity lines in the product.
Figure 2:
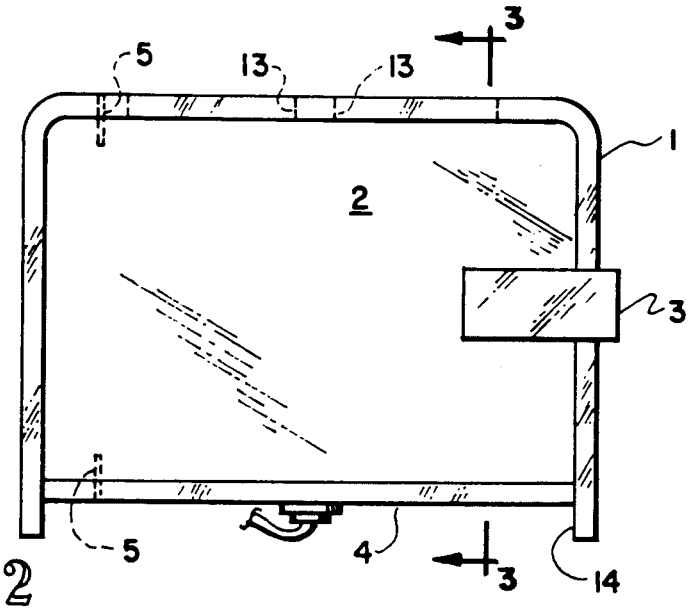
FIG. 2 is a plane view of the front of the warmer.
Figure 3:
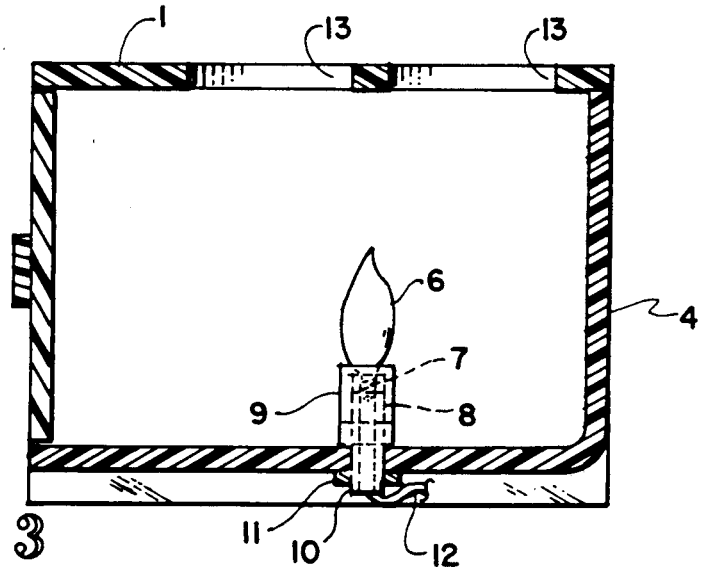
FIG. 3 is a cut-away view from the side showing the heating mechanism used.
Figure 4:
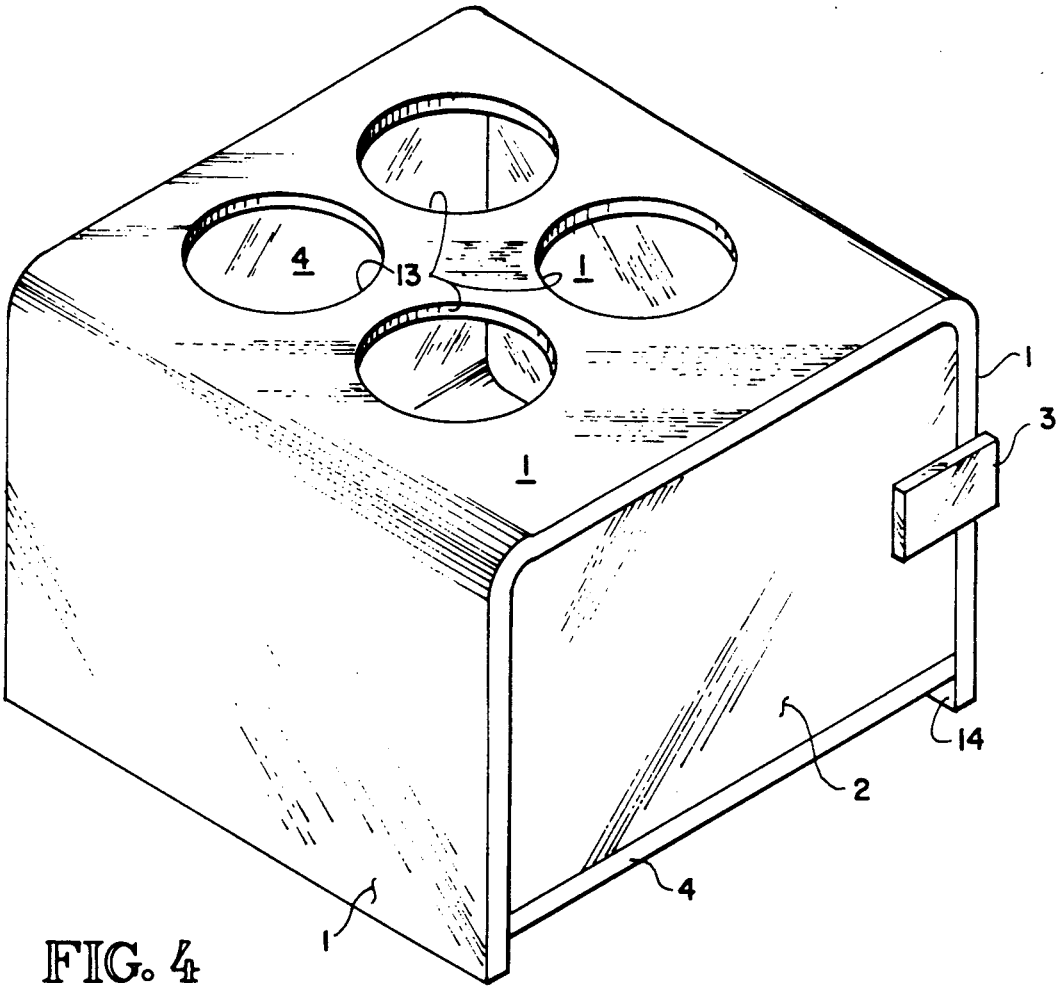
FIG. 4 is a simplified perspective view showing the 4 holes on top surface which houses and secures 4 (16 oz.) plastic bottles preferably polyethylene in type. Space is also provided immediately inside door opening to conveniently place 3 (4 oz.) plastic bottles which contain solutions to be warmed.

Referring to drawing in detail, reference character (1) designates top and sides as one complete piece made from acrylic material preferably plexiglas in type. At equal distances this piece is conveniently curved to custom fit door (2) with matching curved edges at top portion. Door stays stationery with use of handle (3), constructed of same material. Also, custom fitted in place is bottom and back (4) piece. At a specified location at lower back rear of this piece a curve is bent to proportionately match top and sides.

Character (5) pins are placed at top and bottom edges of door to hold door in place and allows door to swing easily.

Viewing inside unit and at a strategic location in bottom portion of unit is found a low voltage candelabra bulb (6) inside its matching bulb socket (7) with electrical parts incased by a cardboard socket cover (9), and a plastic socket cover (8); these are placed respectively in this order. To old socket in place, it is secured by a small pipe (10) with threads and locked with a fitted nut (11). These are located underneath bottom portion of unit. An electrical lamp cord (12) is wired to socket and extends from underneath bottom portion of unit to an electrical outlet not shown.

Character (13) refers to 4 (2⅝") holes proportionately placed in top of unit to house the necessary 4 (16 oz.) bottles which can be filled with several desired solutions mentioned earlier. Horizontal leg extensions (14) are created by over-extending top and side portions of unit. This conveniently allows unit to easily be placed on countertops.

Figure 5:
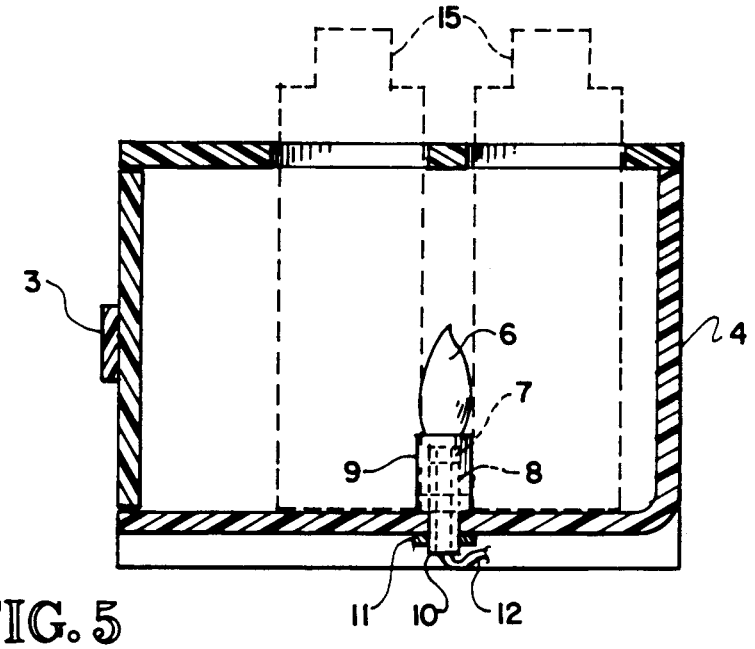
FIG. 5 is a side sectional view with the bottles in place.

Character (15) in FIG. 5 refers to 2 (16 oz.) bottles that are securely proportioned in place by inserting through holes in the top wall. Sufficient equalized space has been created between bottles and heating lamp which allows proper circulation of warmed air present.

I claim:

1. A solution warming device comprising:

A heating chamber enclosed by a generally rectangular plastic housing having an upper wall, a lower wall, a back wall, two side walls, and a front wall;

A heating bulb supported by said lower wall of said housing and connected to a source of power to provide heat to the chamber;

A plurality of holes in said upper wall of said housing, each said hole being proportioned for receiving a bottle of solution to be warmed;

A plurality of bottles extending through said holes into the chamber and being supported on said lower wall;

A door in said front wall of said housing to enable insertion of small bottles into the housing through said door.

* * * * *